US009472842B2

(12) United States Patent
Faraone et al.

(10) Patent No.: US 9,472,842 B2
(45) Date of Patent: Oct. 18, 2016

(54) LOW-PROFILE, ANTENNA STRUCTURE FOR AN RFID READER AND METHOD OF MAKING THE ANTENNA STRUCTURE

(71) Applicant: SYMBOL TECHNOLOGIES, INC., Lincolnshire, IL (US)

(72) Inventors: Antonio Faraone, Fort Lauderdale, FL (US); Giorgi Bit-Babik, Plantation, FL (US); Charles B Swope, Coral Springs, FL (US)

(73) Assignee: Symbol Technologies, LLC, Holtsville, NY (US)

( * ) Notice: Subject to any disclaimer, the term of this patent is extended or adjusted under 35 U.S.C. 154(b) by 108 days.

(21) Appl. No.: 14/596,568

(22) Filed: Jan. 14, 2015

(65) Prior Publication Data

US 2016/0204503 A1 Jul. 14, 2016

(51) Int. Cl.

| | |
|---|---|
| ***H01Q 1/36*** | (2006.01) |
| ***H01Q 21/28*** | (2006.01) |
| ***H01Q 21/06*** | (2006.01) |
| ***H01Q 21/00*** | (2006.01) |

(52) U.S. Cl.

CPC ..... *H01Q 1/362* (2013.01); *H01Q 21/0087* (2013.01); *H01Q 21/061* (2013.01); *H01Q 21/28* (2013.01)

(58) Field of Classification Search

CPC ..... H01Q 11/08
USPC ..... 343/700 MS, 742, 853, 866, 867, 895
See application file for complete search history.

(56) References Cited

U.S. PATENT DOCUMENTS 5,896,113 A * 4/1999 O'Neill, Jr. ..... H01Q 11/08 343/853
5,945,963 A * 8/1999 Leisten ..... H01Q 1/242 343/702
5,955,997 A * 9/1999 Ho ..... H01Q 1/36 343/767
6,011,524 A * 1/2000 Jervis ..... H01Q 1/42 343/859
6,094,178 A * 7/2000 Sanford ..... H01Q 1/242 343/860
6,288,686 B1 * 9/2001 Josypenko ..... H01Q 11/08 343/895
6,504,516 B1 1/2003 Davis
7,245,268 B2 * 7/2007 O'Neill, Jr. ..... H01Q 11/08 343/702
7,439,913 B2 10/2008 Chang et al.
7,692,601 B2 4/2010 Bisiules et al.
7,843,392 B2 * 11/2010 Munger ..... H01Q 5/00 343/700 MS
8,587,495 B2 11/2013 Faraone et al.
2013/0141295 A1 6/2013 Jiang et al.

(Continued)

OTHER PUBLICATIONS

"Time Delayed Directional Beam Quadrifilar Helix Phased Array Antenna" by Douglas Fund et al., Copyright 2003 IEEE.
"A Linear Array Antenna Using Bifilar Helical Elements for Mobile Satellite Communications" by Yoshihiko Konishi et al., Copyright 1994 IEEE.

(Continued)

*Primary Examiner* — Tho G Phan

(57) ABSTRACT

An antenna structure, especially for use with a radio frequency identification reader, includes an array of bifilar antennas mounted on a ground support. Each bifilar antenna includes a pair of bifilar helical elements wound at least partially about a helix axis. Each bifilar element has a ground terminal and a transceiver terminal. Independent radio frequency connectors are connected to the transceiver terminals of each bifilar antenna, and transmit and receive radio frequency signals of arbitrary amplitude and phase to and from the transceiver terminals of each bifilar antenna to obtain and steer an antenna beam, both in azimuth around a boresight of the antenna structure and in elevation angularly away from the boresight.

19 Claims, 5 Drawing Sheets

(56) References Cited

U.S. PATENT DOCUMENTS

| | | | |
|---|---|---|---|
| 2013/0273858 | A1 | 10/2013 | Sover et al. |
| 2013/0342397 | A1 | 12/2013 | Turbiner |
| 2014/0152528 | A1 | 6/2014 | Cameron et al. |

OTHER PUBLICATIONS

"The Quadrifilar Helix Antenna" Chapter 22 of book, no date information available, undated.

* cited by examiner

LOW-PROFILE, ANTENNA STRUCTURE FOR AN RFID READER AND METHOD OF MAKING THE ANTENNA STRUCTURE

BACKGROUND OF THE INVENTION

The present disclosure relates generally to a low-profile, low-cost, agile-beam, antenna structure and to a method of making such an antenna structure and, more particularly, to using such an antenna structure with a radio frequency (RF) identification (RFID) reader for scanning RFID tags associated with items in a controlled area, especially for inventory control of the RFID-tagged items.

RFID systems are well known and are commonly utilized for item tracking, item identification, and inventory control in manufacturing, warehouse, and retail environments. Briefly, an RFID system includes two primary components: a reader (also known as an interrogator), and a tag (also known as a transponder). The tag is typically a miniature device that is capable of responding, via an air channel, to an RF interrogating signal generated by the reader. The tag is associated with an item to be monitored and is configured to generate an RF responding signal in response to the RF interrogating signal emitted from the reader. The RF responding signal is modulated in a manner that conveys identification data (also known as a payload) back to the reader. The identification data can then be stored, processed, displayed, or transmitted by the reader as needed. One or more readers can be mounted in a controlled inventory area, for example, in an overhead location on the ceiling, and the readers can cooperate to locate any particular tagged item in the inventory area, for instance, by triangulation.

For superior RFID tag detection and locationing coverage, it is known to provide each reader with an antenna structure that transmits the RF interrogating signal as a transmit beam that is electronically steered and scanned both in azimuth, e.g., over a steering angle of 360 degrees around a vertical plumb line or boresight axis originating from the center of an antenna structure of a ceiling-mounted RFID reader, and in elevation, e.g., over a steering angle span of about 90 degrees angularly away from the plumb line, and that receives the return RF responding signal as a receive beam from the tags. Effective RFID reader-beam scanning performance requires a relatively large beam steering angle range with a relatively narrow beam width even at large elevations, the capability of synthesizing many different beam polarization states, e.g., linear, right-handed or left-handed, circular, etc., excellent symmetry, high directivity, and multi-lobe/multi-null beam formations. To maximize the likelihood of detecting the tag, the RFID system may benefit from the flexibility of generating multiple polarization states for each beam steering angle, thus limiting the likelihood that multi-path signal replicas confound a receiver of the reader. This typically requires the antenna structure to be more complex, or the design of complex signal-routing networks, both factors being associated with an increased cost and size.

In a ceiling-mounted RFID reader, a conventional antenna structure having an array of antenna elements can extend away from the ceiling by a distance of as much as 300 millimeters and more. This is undesirably large for a convenient, unobtrusive, aesthetic installation, especially in an existing venue. Although decreasing the distance between the antenna elements results in a desirably smaller antenna structure, it is typically obtained at the expense of lower isolation, poorer gain, and poorer beam-scanning performance caused by mutual coupling between the antenna elements, which typically results in wasted transmit power during transmission, and a lower received power from incoming signals during reception. It can also limit the effective beam steering angle range.

Accordingly, there is a need for a low-profile, low-cost, agile-beam, antenna structure with the characteristics of a high isolation, a narrow beam width over a broad range of steering angles, and a high polarization synthesis capability, for enhanced performance, as well as to a method of making such an antenna structure, especially for use with an RFID reader for scanning RFID tags associated with items in a controlled area, especially for inventory control of the RFID-tagged items.

BRIEF DESCRIPTION OF THE SEVERAL VIEWS OF THE DRAWINGS

The accompanying figures, where like reference numerals refer to identical or functionally similar elements throughout the separate views, together with the detailed description below, are incorporated in and form part of the specification, and serve to further illustrate embodiments of concepts that include the claimed invention, and explain various principles and advantages of those embodiments.

Figure 1:
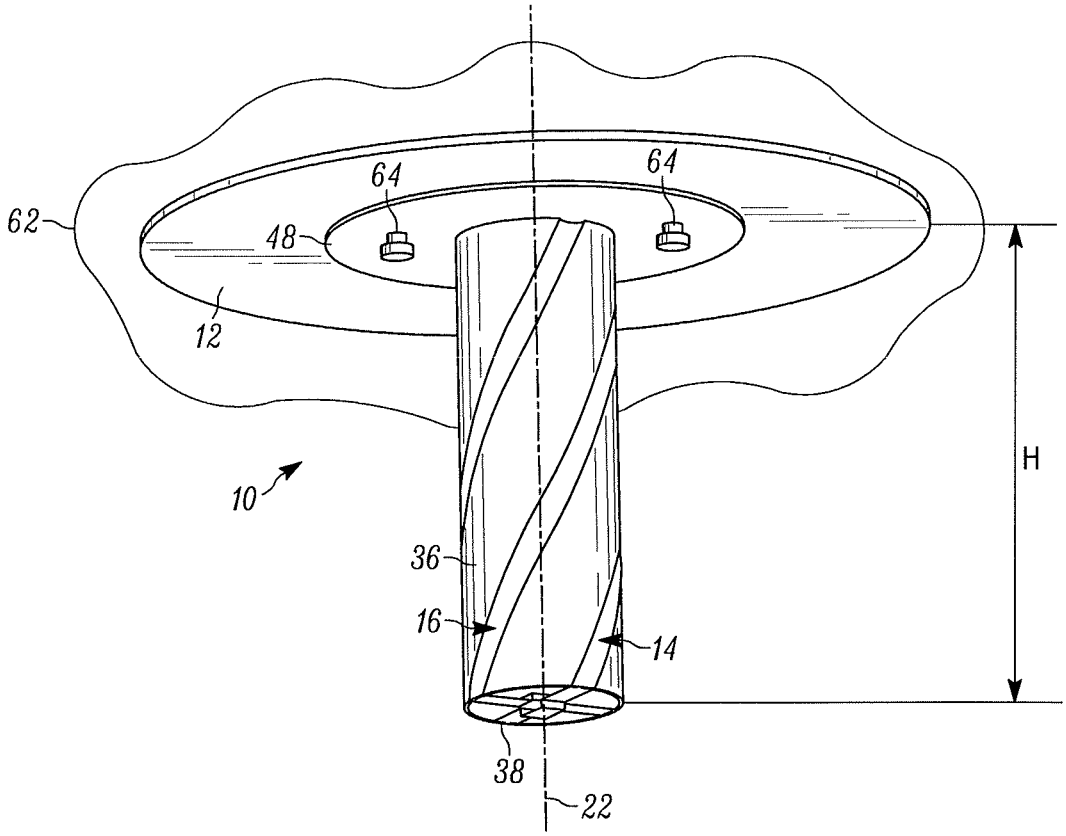
FIG. 1 is a perspective view of a low-profile, low-cost, agile-beam, ceiling-mounted, antenna structure in accordance with one embodiment of the present disclosure.

Skilled artisans will appreciate that elements in the figures are illustrated for simplicity and clarity and have not necessarily been drawn to scale. For example, the dimensions and locations of some of the elements in the figures may be exaggerated relative to other elements to help to improve understanding of embodiments of the present invention.

The method and structural components have been represented where appropriate by conventional symbols in the drawings, showing only those specific details that are pertinent to understanding the embodiments of the present invention so as not to obscure the disclosure with details that will be readily apparent to those of ordinary skill in the art having the benefit of the description herein.

DETAILED DESCRIPTION OF THE INVENTION

One aspect of this disclosure relates to an antenna structure, which comprises a ground support, such as a ground plane, and a bifilar helical antenna having first and second electrically conductive, bifilar helical elements mounted on the ground support. The first bifilar helical element has two first volutes that are wound at least partially about a helix axis that is generally perpendicular to the ground support and that extend away from the ground support over a distance along the helix axis. The first bifilar element has a first ground terminal that is electrically grounded to the ground support at an end region of one of the first volutes, and a first transceiver terminal that is spaced away from the first ground terminal at an end region of the other of the first volutes. The second bifilar helical element has two second volutes that are wound at least partially about the same helix axis and that extend away from the ground support over the same distance along the helix axis. The second bifilar element has a second ground terminal that is electrically grounded to the ground support at an end region of one of the second volutes, and a second transceiver terminal that is spaced away from the second ground terminal at an end region of the other of the second volutes.

The antenna structure further has two independent radio frequency connectors that are separately connected to the first and second transceiver terminals. The connectors are connected to a transceiver system, and are operative for transmitting and receiving radio frequency signals of arbitrary amplitude and phase to and from the first and second transceiver terminals of the bifilar elements to obtain and steer an antenna beam, both in azimuth around the helix axis and in elevation angularly away from the helix axis.

In a preferred embodiment, the first ground terminal and the first transceiver terminal are located 180 degrees apart on the ground support, and the second ground terminal and the second transceiver terminal are also located 180 degrees apart on the ground support. The first and second ground terminals and the first and second transceiver terminals are spaced angularly apart in a circumferential direction around the helix axis. The first volutes are mirror symmetrical relative to each other at opposite sides of the helix axis, and the second volutes are also mirror symmetrical relative to each other at opposite sides of the helix axis. The first volutes are spaced 90 degrees apart from the second volutes in a circumferential direction around the helix axis.

Advantageously, an electrically insulating, support cylinder is mounted on, and extends along the helix axis away from, the ground support. The support cylinder has a remote cylindrical end that is located at the aforementioned distance. The first volutes are electrically conductive, generally planar strips that are supported by the support cylinder and that are electrically shorted by a first shorting strip that extends across the cylindrical end along a first direction, and the second volutes are also electrically conductive, generally planar strips that are supported by the support cylinder and that are electrically shorted by a second shorting strip that extends across the cylindrical end along a second direction that is generally perpendicular to the first direction. The first and second shorting strips are electrically isolated from each other.

Another aspect of this disclosure relates to configuring an antenna structure as an array of bifilar antennas having a boresight, each bifilar antenna being identical in structure and function to the aforementioned bifilar antenna, and by mounting the bifilar antennas in a spaced-apart relation on a common ground support. Advantageously, a plurality of the bifilar antennas is mounted in an annulus on the ground support, and another of the bifilar antennas is mounted in a center of the annulus. Preferably, the antenna array structure is employed with a radio frequency (RF) identification (RFID) reader, wherein each bifilar antenna radiates radio frequency waves in the same operating band of frequencies, e.g., in a frequency range on the order of 902-928 MHz. Other frequency ranges are also contemplated. As described above, an overhead RFID reader transmits the RF interrogating signal as a transmit beam that can be electronically steered and scanned both in azimuth, e.g., over a steering angle of 360 degrees around the boresight, and in elevation, e.g., over a steering angle of about 90 degrees angularly away from the boresight, and receives the return RF responding signal from the tags as a receive beam. The array of bifilar antennas serves to narrow the width of these beams, thereby enhancing the tag detection likelihood since more power is available to trigger the tag response. Also, multi-path effects are mitigated since received signal replicas from off-beam directions are strongly attenuated. The array of bifilar antennas also serves to enhance the accuracy of the determination of the location and true bearing of each tag.

A method of making an antenna structure, in accordance with another aspect of this disclosure, is performed by mounting an array of bifilar antennas having a boresight in a spaced-apart relation on a common ground support; by configuring each bifilar antenna with a first electrically conductive, bifilar helical element having a pair of first volutes wound at least partially about a helix axis that is generally perpendicular to the ground support and extending away from the ground support over a distance along the helix axis, by configuring the first bifilar element with a first ground terminal that is electrically grounded to the ground support at an end region of one of the first volutes, and with a first transceiver terminal that is spaced away from the first ground terminal at an end region of the other of the first volutes; and by configuring each bifilar antenna with a second electrically conductive, bifilar helical element having a pair of second volutes wound at least partially about the same helix axis and extending away from the ground support over the same distance along the helix axis, and by configuring the second bifilar element with a second ground terminal that is electrically grounded to the ground support at an end region of one of the second volutes, and with a second transceiver terminal that is spaced away from the second ground terminal at an end region of the other of the second volutes. The method is further performed by separately connecting a pair of independent radio frequency connectors to the first and second transceiver terminals of each bifilar antenna, and by transmitting and receiving radio frequency signals of arbitrary amplitude and phase to and from the first and second transceiver terminals of each bifilar antenna to obtain and steer an antenna beam, both in azimuth around the boresight and in elevation angularly away from the boresight.

Turning now to FIGS. 1-5 of the drawings, reference numeral 10 generally identifies a low-profile, low-cost, agile-beam, bifilar helical antenna with a high port isolation, a broad beam steering angle range, a narrow beam width, and a high polarization synthesis capability. The bifilar antenna 10 is preferably mounted overhead, for example, on a ceiling 62, and includes an electrically conductive, ground support, which is configured as a ground plane 12; a first, electrically conductive, bifilar helical element 14 mounted on the ground plane 12; and a second, electrically conductive, bifilar helical element 16 also mounted on the ground plane 12.

Figure 3:
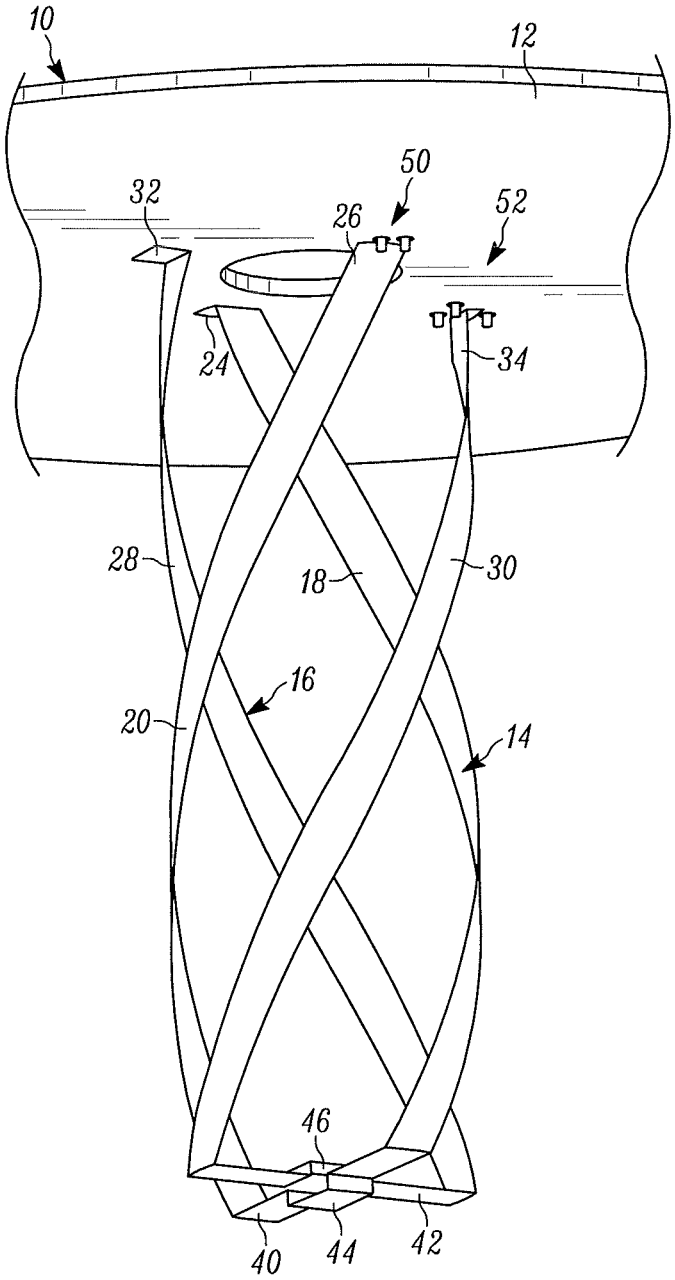
FIG. 3 is an enlarged, broken-away, perspective view of the antenna structure of FIG. 1, with certain components removed for clarity.

As best seen in FIG. 3, the first bifilar helical element 14 has two legs or first volutes 18, 20 that are wound or twisted at least partially about a boresight or upright helix axis 22 (see FIG. 1) that is generally perpendicular to the ground plane 12. The first volutes 18, 20 extend away from the ground plane 12 over a distance or height (H) along the helix axis 22. The first bifilar element 14 has a first ground terminal 24 that is electrically grounded to the ground plane 12 at an end region of one of the first volutes, e.g., volute 18, and a first transceiver terminal 26 that is spaced away from the first ground terminal 24 at an end region of the other of the first volutes, e.g., volute 20.

The second bifilar helical element 16 has two legs or second volutes 28, 30 that are wound or twisted at least partially about the same helix axis 22 and that extend away from the ground plane 12 over the same height (H) along the helix axis 22. The second bifilar element 16 has a second ground terminal 32 that is electrically grounded to the ground plane 12 at an end region of one of the second volutes, e.g., volute 28, and a second transceiver terminal 34 that is spaced away from the second ground terminal 32 at an end region of the other of the second volutes, e.g., volute 30.

In a preferred embodiment, the first ground terminal 24 and the first transceiver terminal 26 are located 180 degrees apart on the ground plane 12, and the second ground terminal 32 and the second transceiver terminal 34 are also located 180 degrees apart on the ground plane 12. The first and second ground terminals 24, 32 and the first and second transceiver terminals 26, 34 are all spaced angularly apart, preferably equiangularly, in a circumferential direction around the helix axis 22. The first volutes 18, 20 are mirror symmetrical relative to each other at opposite sides of the helix axis 22, and the second volutes 28, 30 are also mirror symmetrical relative to each other at opposite sides of the helix axis. The first volutes 18, 20 are spaced 90 degrees apart from the second volutes 28, 30 in a circumferential direction around the helix axis 22.

Advantageously, an electrically insulating, support cylinder 36 is mounted on, and extends along the helix axis 22 away from, the ground plane 12. The support cylinder 36 is preferably a hollow, right circular cylinder and has a remote, circular end 38 that is located at the aforementioned height (H). Preferably, each of the first volutes 18, 20 and the second volutes 28, 30 are electrically conductive, generally planar strips of rectangular cross-section, and are supported by an outer cylindrical surface of the support cylinder 36. For example, the support cylinder 36 can be a flexible, generally planar, printed circuit board on which the strips are printed as conductive traces, and thereupon the board is rolled into a cylindrical shape.

Figure 2:
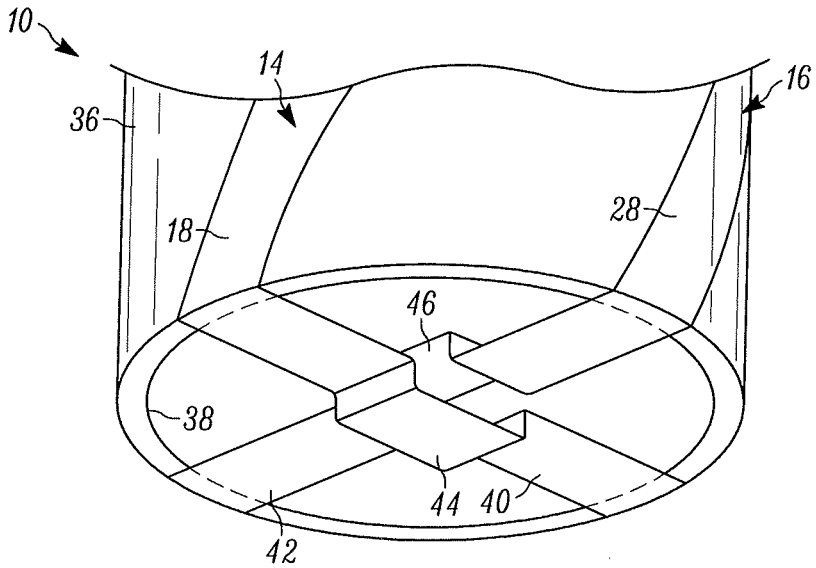
FIG. 2 is an enlarged, broken-away, perspective view of a lower end region of the antenna structure of FIG. 1.

As best shown in FIGS. 2-3, the first volutes 18, 20 are electrically shorted by a first shorting strip 40 that extends across the cylindrical end 38 along a first radial direction, and the second volutes 28, 30 are electrically shorted by a second shorting strip 42 that extends across the cylindrical end 38 along a second radial direction that is generally perpendicular to the first direction. The first and second shorting strips 40, 42 are electrically isolated from each other. As illustrated, this isolation can be accomplished by providing offsets 44, 46 that are spaced apart by an air gap, or by inserting a dielectric (not illustrated) between the shorting strips 40, 42.

As best shown in FIG. 1, an electrically insulating, circular disc 48 is mounted on top of the ground plane 12 and is fastened thereto by fasteners 64. The disc 48 surrounds the support cylinder 36, and overlies the ground terminals 24, 32. The disc 48 has been omitted from FIGS. 2-5, and the support cylinder 36 has been omitted from FIG. 3, in order to better show the structure of the bifilar elements 14, 16.

Figure 4:
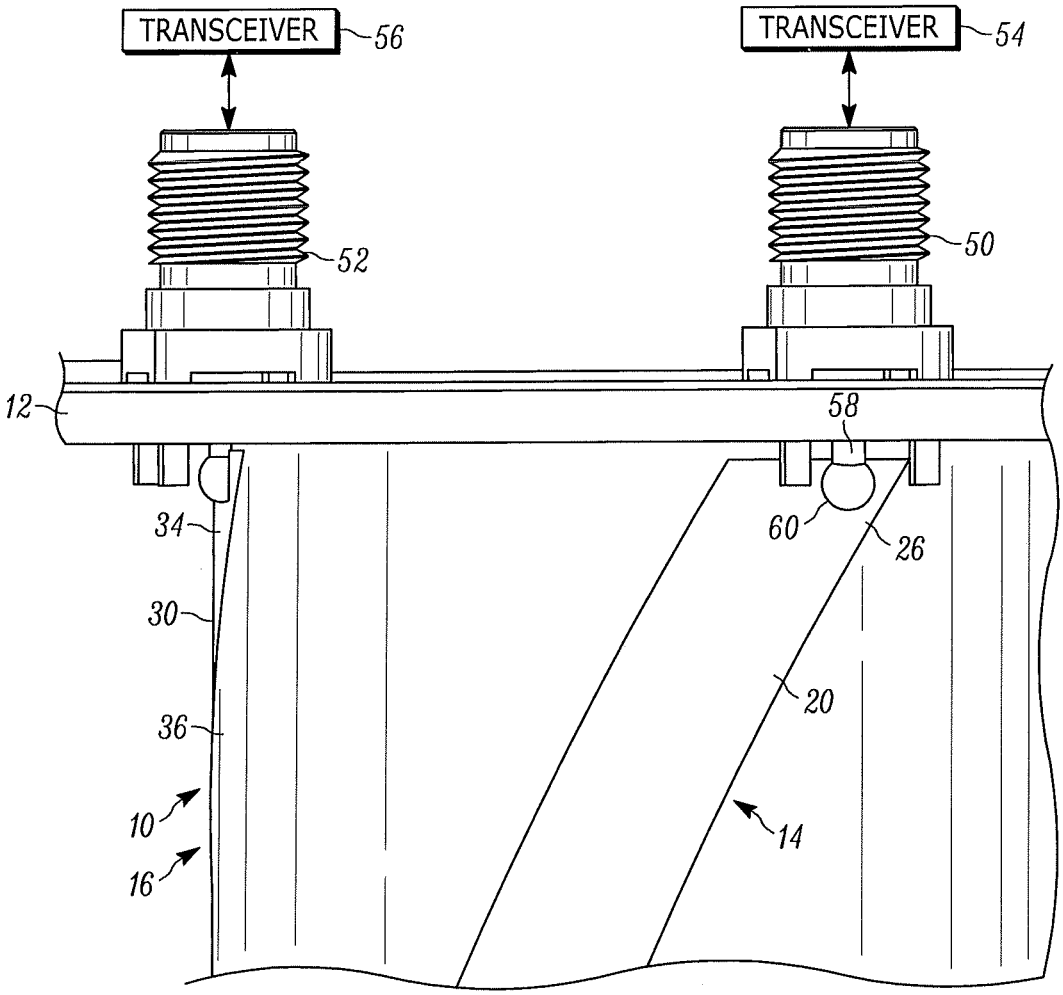
FIG. 4 is an enlarged, broken-away, side view depicting independent radio frequency connectors for the antenna structure of FIG. 1.
Figure 5:
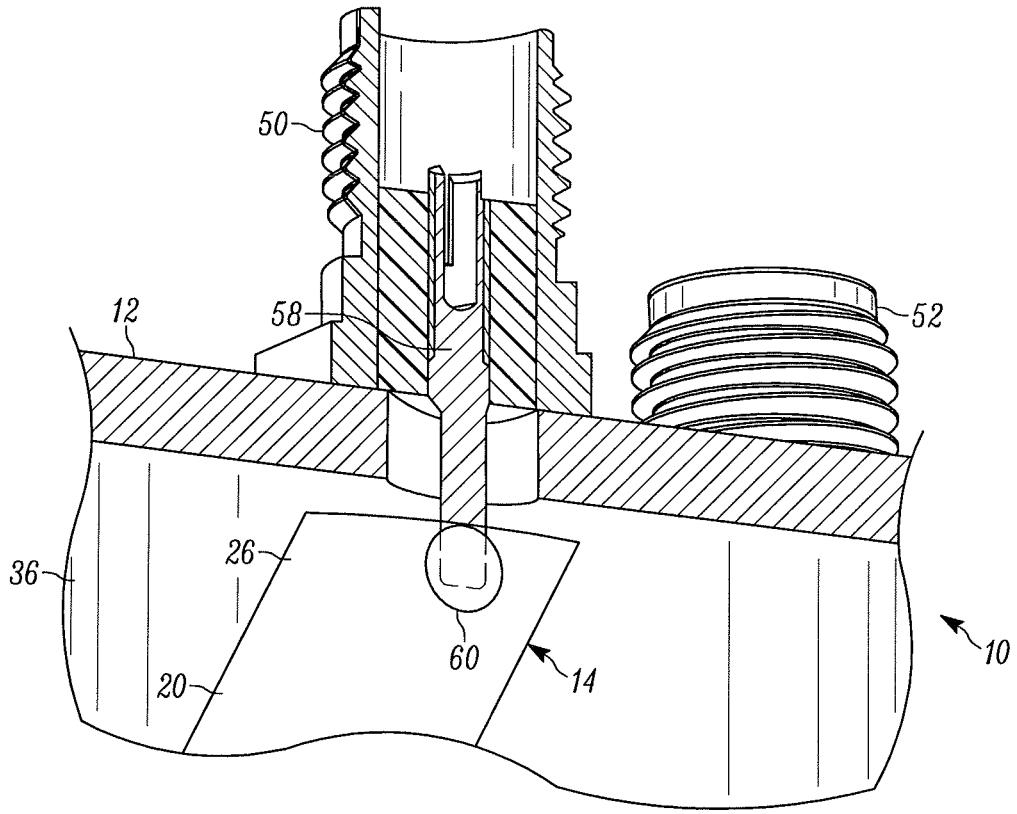
FIG. 5 is an enlarged, sectional, perspective view taken though one of the connectors of FIG. 4.

As best shown in FIG. 4, the bifilar antenna 10 further has two independent radio frequency (RF) coaxial cable connectors 50, 52 that are separately connected to the first transceiver terminal 26 and the second transceiver terminal 34. As shown in FIG. 5, for representative connector 50, an electrically conductive, center core 58 is soldered or welded at a joint or weld 60 to the representative transceiver terminal 26. The connectors 50, 52 are connected to two separate transceivers 54, 56, and are operative for transmitting and receiving RF signals to and from the first transceiver terminal 26 and the second transceiver terminal 34 of the bifilar elements 14, 16. The RF signals may have any arbitrary amplitude and phase and, hence, are independent of each other, to obtain and steer an antenna beam, both in azimuth around the helix axis 22 and in elevation angularly away from the helix axis 22. When the bifilar antenna 10 is mounted overhead, as shown in FIG. 1, the helix axis 22 is the vertical plumb line or boresight, and the antenna beam is electronically steered and scanned both in azimuth, e.g., over a steering angle of 360 degrees around the boresight, and in elevation, e.g., over a steering angle span of about 90 degrees angularly away from the boresight.

Figure 6:
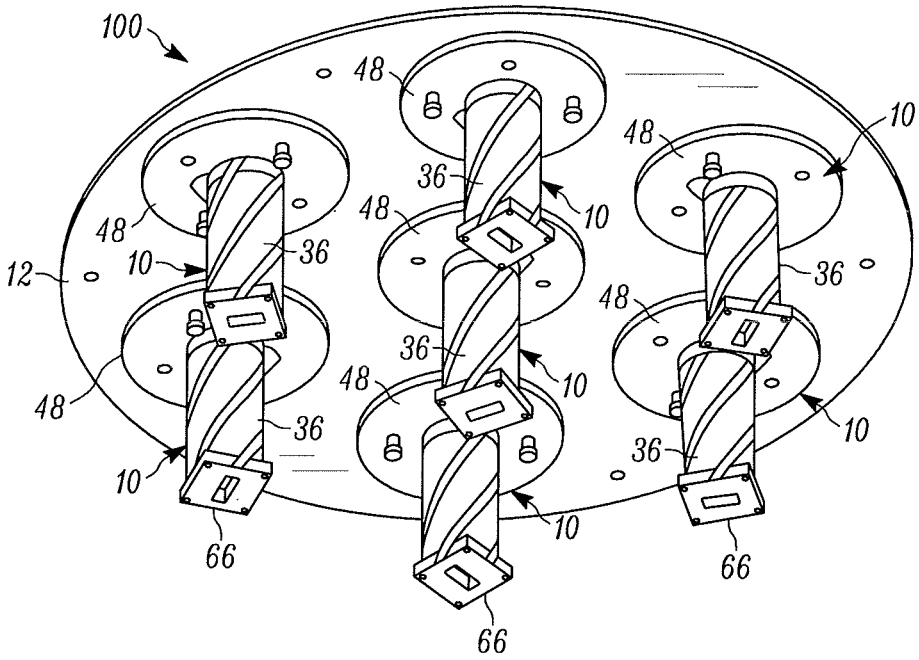
FIG. 6 is a perspective view of a low-profile, low-cost, agile-beam, ceiling-mounted, antenna array structure in accordance with another embodiment of the present disclosure.
Figure 7:
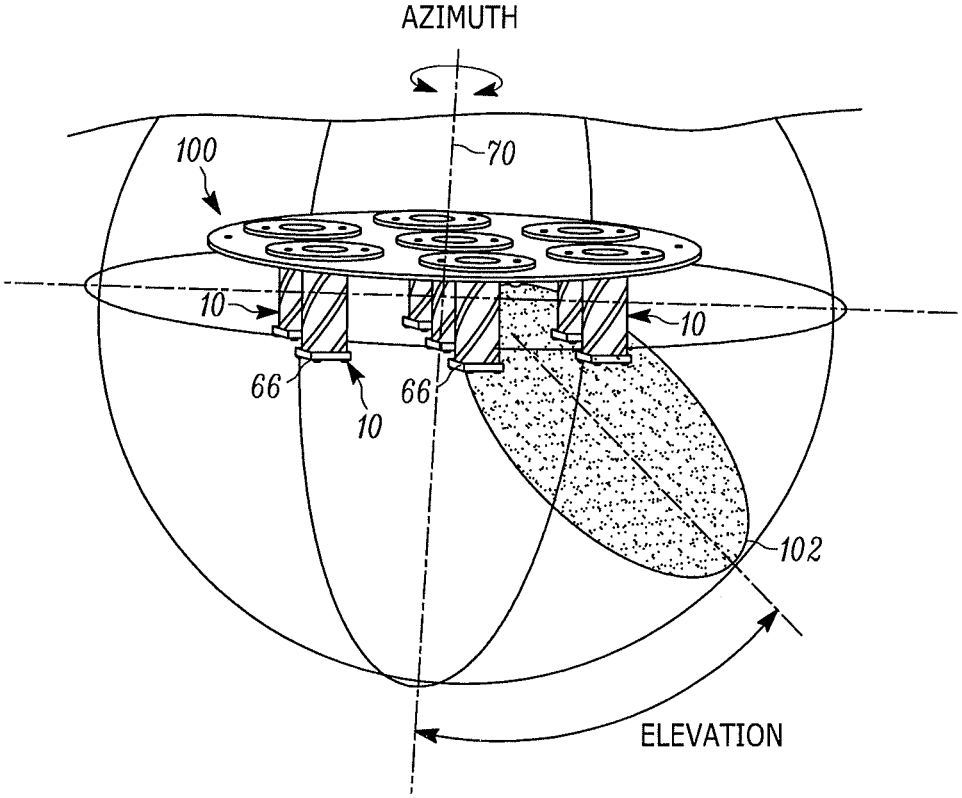
FIG. 7 is a perspective, side view of the antenna array structure of FIG. 6, and depicting a beam steerable in azimuth and in elevation.

In a preferred embodiment, as shown in FIGS. 6-7, an array of bifilar antennas 10 having a boresight 70, each of the bifilar antennas being essentially identical in structure and function to the aforementioned bifilar antenna 10, is commonly mounted in a spaced-apart relation on the ground plane 12 to form an antenna array structure 100. Advantageously, a plurality of the bifilar antennas 10 is mounted in an annulus on the ground plane 12, and another of the bifilar antennas 10 is mounted in a center of the annulus. Each bifilar antenna 10 in FIGS. 6-7 is shown with a dielectric cap 66 at the far axial end 38 of the respective support cylinder 36. Preferably, the antenna array structure 100 is employed with a radio frequency (RF) identification (RFID) reader, wherein each bifilar antenna 10 radiates radio frequency waves in the same operating band of frequencies, e.g., in a frequency range on the order of 902-928 MHz. Other frequency ranges are also contemplated. As described above, the RF interrogating signals are fed to each pair of connectors 50, 52 on each bifilar antenna 10, and the antenna array structure 100 radiates a transmit beam 102 that can be electronically steered and scanned both in azimuth, e.g., over a steering angle of 360 degrees around the boresight 70, and in elevation, e.g., over a steering angle of about 90 degrees angularly away from the boresight 70, and receives the return RF responding signals from the tags as a receive beam. The array of bifilar antennas 10 serves to narrow the width of these beams 100, thereby enhancing the tag detection likelihood since more power is available to trigger the tag response. Also, multi-path effects are mitigated since received signal replicas from off-beam directions are strongly attenuated. The array of bifilar antennas 10 also serves to enhance the accuracy of the determination of the location and true bearing of each tag.

The antenna array structure disclosed herein has an overall height much less than the 300 mm known in the art and, hence, is well suited for installation in an unobtrusive, aesthetic manner, especially in an existing venue. The bifilar elements on each bifilar antenna, as well as with the bifilar elements on adjacent bifilar antennas, are well isolated from each other, e.g., on an order exceeding 10 dB. The ability to separately control each bifilar element of each bifilar antenna enables the antenna array structure disclosed herein to have more gain (on an order of 10 dB), a narrower beam width, a high polarization synthesis capability, and reduced sidelobes as compared to known antenna structures. Reducing the twist of each bifilar element increases the gain of an endfire beam, i.e., a beam directed along the horizontal direction.

In the foregoing specification, specific embodiments have been described. However, one of ordinary skill in the art appreciates that various modifications and changes can be made without departing from the scope of the invention as set forth in the claims below. For example, the number of partial or full turns of each bifilar element about its respective helix axis, and the axial distance between such partial or full turns, can be varied. The overall height (H), and the diameter of the cylinder support 36, can be selected, as desired. The bifilar elements need not be strips with rectangular cross-sections, but could be some other conductors, such as electrical wires with round cross-sections. In the antenna array structure 100, each bifilar antenna need not be identical to one another, but selected ones could be configured differently from one another. The array need not have six bifilar antennas arranged in an annulus, but a different number could be provided. Rather than in an annulus, the bifilar antennas could be arranged in other configurations, such as a lattice having mutually orthogonal rows and columns. The transceivers 54, 56 need not be discrete, but could be integrated into a transceiver system that has independent RF ports. Accordingly, the specification and figures are to be regarded in an illustrative rather than a restrictive sense, and all such modifications are intended to be included within the scope of present teachings.

The benefits, advantages, solutions to problems, and any element(s) that may cause any benefit, advantage, or solution to occur or become more pronounced are not to be construed as a critical, required, or essential features or elements of any or all the claims. The invention is defined solely by the appended claims including any amendments made during the pendency of this application and all equivalents of those claims as issued.

Moreover in this document, relational terms such as first and second, top and bottom, and the like may be used solely to distinguish one entity or action from another entity or action without necessarily requiring or implying any actual such relationship or order between such entities or actions. The terms "comprises," "comprising," "has," "having," "includes," "including," "contains," "containing," or any other variation thereof, are intended to cover a non-exclusive inclusion, such that a process, method, article, or apparatus that comprises, has, includes, contains a list of elements does not include only those elements, but may include other elements not expressly listed or inherent to such process, method, article, or apparatus. An element proceeded by "comprises . . . a," "has . . . a," "includes . . . a," or "contains . . . a," does not, without more constraints, preclude the existence of additional identical elements in the process, method, article, or apparatus that comprises, has, includes, or contains the element. The terms "a" and "an" are defined as one or more unless explicitly stated otherwise herein. The terms "substantially," "essentially," "approximately," "about," or any other version thereof, are defined as being close to as understood by one of ordinary skill in the art, and in one non-limiting embodiment the term is defined to be within 10%, in another embodiment within 5%, in another embodiment within 1%, and in another embodiment within 0.5%. The term "coupled" as used herein is defined as connected, although not necessarily directly and not necessarily mechanically. A device or structure that is "configured" in a certain way is configured in at least that way, but may also be configured in ways that are not listed.

It will be appreciated that some embodiments may be comprised of one or more generic or specialized processors (or "processing devices") such as microprocessors, digital signal processors, customized processors, and field programmable gate arrays (FPGAs), and unique stored program instructions (including both software and firmware) that control the one or more processors to implement, in conjunction with certain non-processor circuits, some, most, or all of the functions of the method and/or apparatus described herein. Alternatively, some or all functions could be implemented by a state machine that has no stored program instructions, or in one or more application specific integrated circuits (ASICs), in which each function or some combinations of certain of the functions are implemented as custom logic. Of course, a combination of the two approaches could be used.

Moreover, an embodiment can be implemented as a computer-readable storage medium having computer readable code stored thereon for programming a computer (e.g., comprising a processor) to perform a method as described and claimed herein. Examples of such computer-readable storage mediums include, but are not limited to, a hard disk, a CD-ROM, an optical storage device, a magnetic storage device, a ROM (Read Only Memory), a PROM (Programmable Read Only Memory), an EPROM (Erasable Programmable Read Only Memory), an EEPROM (Electrically Erasable Programmable Read Only Memory) and a Flash memory. Further, it is expected that one of ordinary skill, notwithstanding possibly significant effort and many design choices motivated by, for example, available time, current technology, and economic considerations, when guided by the concepts and principles disclosed herein, will be readily capable of generating such software instructions and programs and ICs with minimal experimentation.

The Abstract of the Disclosure is provided to allow the reader to quickly ascertain the nature of the technical disclosure. It is submitted with the understanding that it will not be used to interpret or limit the scope or meaning of the claims. In addition, in the foregoing Detailed Description, it can be seen that various features are grouped together in various embodiments for the purpose of streamlining the disclosure. This method of disclosure is not to be interpreted as reflecting an intention that the claimed embodiments require more features than are expressly recited in each claim. Rather, as the following claims reflect, inventive subject matter lies in less than all features of a single disclosed embodiment. Thus, the following claims are hereby incorporated into the Detailed Description, with each claim standing on its own as a separately claimed subject matter.

The invention claimed is:

1. An antenna structure, comprising:

a ground support;

a first electrically conductive, bifilar helical element mounted on the ground support and having a pair of first volutes wound at least partially about a helix axis that is generally perpendicular to the ground support and extending away from the ground support over a distance along the helix axis, the first bifilar element having a first ground terminal that is electrically grounded to the ground support at an end region of one of the first volutes, and a first transceiver terminal that is spaced away from the first ground terminal at an end region of the other of the first volutes;

a second electrically conductive, bifilar helical element mounted on the ground support and having a pair of second volutes wound at least partially about the same helix axis and extending away from the ground support over the same distance along the helix axis, the second bifilar element having a second ground terminal that is electrically grounded to the ground support at an end region of one of the second volutes, and a second transceiver terminal that is spaced away from the second ground terminal at an end region of the other of the second volutes; and a pair of independent radio frequency connectors separately connected to the first and second transceiver terminals, and operative for transmitting and receiving radio frequency signals of arbitrary amplitude and phase to and from the first and second transceiver terminals of the bifilar elements to obtain and steer an antenna beam, both in azimuth around the helix axis and in elevation angularly away from the helix axis.

2. The antenna structure of claim 1, wherein the first ground terminal and the first transceiver terminal are located 180 degrees apart on the ground support, wherein the second ground terminal and the second transceiver terminal are located 180 degrees apart on the ground support, and wherein the first and second ground terminals and the first and second transceiver terminals are spaced angularly apart in a circumferential direction around the helix axis.

3. The antenna structure of claim 1, wherein the first volutes are mirror symmetrical relative to each other at opposite sides of the helix axis, wherein the second volutes are mirror symmetrical relative to each other at opposite sides of the helix axis, and wherein the first volutes are spaced 90 degrees apart from the second volutes in a circumferential direction around the helix axis.

4. The antenna structure of claim 1, and an electrically insulating, support cylinder mounted on, and extending along the helix axis away from, the ground support, and wherein the support cylinder has a remote cylindrical end that is located at the distance; and wherein the first volutes are electrically conductive, generally planar strips that are supported by the support cylinder and that are electrically shorted by a first shorting strip that extends across the cylindrical end along a first direction, and wherein the second volutes are electrically conductive, generally planar strips that are supported by the support cylinder and that are electrically shorted by a second shorting strip that extends across the cylindrical end along a second direction that is generally perpendicular to the first direction, and wherein the first and second shorting strips are electrically isolated from each other.

5. The antenna structure of claim 1, and a pair of independent transceivers for separately feeding and receiving the radio frequency signals to and from the radio frequency connectors.

6. An antenna structure, comprising:

a common ground support;

an array of bifilar antennas having a boresight and being mounted in a spaced-apart relation on the ground support, each bifilar antenna including a first electrically conductive, bifilar helical element having a pair of first volutes wound at least partially about a helix axis that is generally perpendicular to the ground support and extending away from the ground support over a distance along the helix axis, the first bifilar element having a first ground terminal that is electrically grounded to the ground support at an end region of one of the first volutes, and a first transceiver terminal that is spaced away from the first ground terminal at an end region of the other of the first volutes, and a second electrically conductive, bifilar helical element having a pair of second volutes wound at least partially about the same helix axis and extending away from the ground support over the same distance along the helix axis, the second bifilar element having a second ground terminal that is electrically grounded to the ground support at an end region of one of the second volutes, and a second transceiver terminal that is spaced away from the second ground terminal at an end region of the other of the second volutes; and a pair of independent radio frequency connectors separately connected to the first and second transceiver terminals of each bifilar antenna, and operative for transmitting and receiving radio frequency signals of arbitrary amplitude and phase to and from the first and second transceiver terminals of each bifilar antenna to obtain and steer an antenna beam, both in azimuth around the boresight and in elevation angularly away from the boresight.

7. The antenna structure of claim 6, wherein the first ground terminal and the first transceiver terminal of each bifilar antenna are located 180 degrees apart on the ground support, wherein the second ground terminal and the second transceiver terminal of each bifilar antenna are located 180 degrees apart on the ground support, and wherein the first and second ground terminals of each bifilar antenna and the first and second transceiver terminals of each bifilar antenna are spaced angularly apart in a circumferential direction around the helix axis.

8. The antenna structure of claim 6, wherein the first volutes of each bifilar antenna are mirror symmetrical relative to each other at opposite sides of the helix axis, wherein the second volutes of each bifilar antenna are mirror symmetrical relative to each other at opposite sides of the helix axis, and wherein the first volutes of each bifilar antenna are spaced 90 degrees apart from the second volutes of each bifilar antenna in a circumferential direction around the helix axis.

9. The antenna structure of claim 6, and an electrically insulating, support cylinder mounted on, and extending along the helix axis away from, the ground support for each bifilar antenna, and wherein the support cylinder of each bifilar antenna has a remote cylindrical end that is located at the distance; and wherein the first volutes of each bifilar antenna are electrically conductive, generally planar strips that are supported by the support cylinder and that are electrically shorted by a first shorting strip that extends across the cylindrical end along a first direction, and wherein the second volutes of each bifilar antenna are electrically conductive, generally planar strips that are supported by the support cylinder and that are electrically shorted by a second shorting strip that extends across the cylindrical end along a second direction that is generally perpendicular to the first direction, and wherein the first and second shorting strips of each bifilar antenna are electrically isolated from each other.

10. The antenna structure of claim 6, wherein the radio frequency signals lie in a frequency range on the order of 902-928 MHz to accommodate a radio frequency identification reader.

11. The antenna structure of claim 6, wherein the array of bifilar antennas include a plurality of the bifilar antennas mounted in an annulus on the ground support, and another of the bifilar antennas mounted in a center of the annulus.

12. The antenna structure of claim 6, and a pair of independent transceivers for each bifilar antenna for separately feeding and receiving the radio frequency signals to and from the radio frequency connectors for each bifilar antenna.

13. A method of making an antenna structure, comprising:

mounting an array of bifilar antennas having a boresight in a spaced-apart relation on a common ground support;

configuring each bifilar antenna with a first electrically conductive, bifilar helical element having a pair of first volutes wound at least partially about a helix axis that is generally perpendicular to the ground support and extending away from the ground support over a distance along the helix axis, and configuring the first bifilar element with a first ground terminal that is electrically grounded to the ground support at an end region of one of the first volutes, and with a first transceiver terminal that is spaced away from the first ground terminal at an end region of the other of the first volutes;

configuring each bifilar antenna with a second electrically conductive, bifilar helical element having a pair of second volutes wound at least partially about the same helix axis and extending away from the ground support over the same distance along the helix axis, and configuring the second bifilar element with a second ground terminal that is electrically grounded to the ground support at an end region of one of the second volutes, and with a second transceiver terminal that is spaced away from the second ground terminal at an end region of the other of the second volutes;

separately connecting a pair of independent radio frequency connectors to the first and second transceiver terminals of each bifilar antenna; and transmitting and receiving radio frequency signals of arbitrary amplitude and phase to and from the first and second transceiver terminals of each bifilar antenna to obtain and steer an antenna beam, both in azimuth around the boresight and in elevation angularly away from the boresight.

14. The method of claim 13, and locating the first ground terminal and the first transceiver terminal of each bifilar antenna to be 180 degrees apart on the ground support, and locating the second ground terminal and the second transceiver terminal of each bifilar antenna to be 180 degrees apart on the ground support, and spacing the first and second ground terminals of each bifilar antenna and the first and second transceiver terminals of each bifilar antenna to be angularly apart in a circumferential direction around the helix axis.

15. The method of claim 13, and configuring the first volutes of each bifilar antenna to be mirror symmetrical relative to each other at opposite sides of the helix axis, and configuring the second volutes of each bifilar antenna to be mirror symmetrical relative to each other at opposite sides of the helix axis, and spacing the first volutes of each bifilar antenna to be 90 degrees apart from the second volutes of each bifilar antenna in a circumferential direction around the helix axis.

16. The method of claim 13, and mounting an electrically insulating, support cylinder on, and configuring the support cylinder to extend along the helix axis away from, the ground support for each bifilar antenna, and configuring the support cylinder of each bifilar antenna to have a remote cylindrical end located at the distance; and configuring the first volutes of each bifilar antenna as electrically conductive, generally planar strips that are supported by the support cylinder and that are electrically shorted by a first shorting strip that extends across the cylindrical end along a first direction, and configuring the second volutes of each bifilar antenna as electrically conductive, generally planar strips that are supported by the support cylinder and that are electrically shorted by a second shorting strip that extends across the cylindrical end along a second direction that is generally perpendicular to the first direction, and electrically isolating the first and second shorting strips of each bifilar antenna from each other.

17. The method of claim 13, and configuring the radio frequency signals to lie in a frequency range on the order of 902-928 MHz to accommodate a radio frequency identification reader.

18. The method of claim 13, wherein the mounting of the array of bifilar antennas is performed by mounting a plurality of the bifilar antennas in an annulus on the ground support, and by mounting another of the bifilar antennas in a center of the annulus.

19. The method of claim 13, and separately feeding and receiving the radio frequency signals to and from the radio frequency connectors for each bifilar antenna with a pair of independent transceivers for each bifilar antenna.

* * * * *